US005338493A

United States Patent [19]

Welch

[11] Patent Number: 5,338,493

[45] Date of Patent: Aug. 16, 1994

[54] METHOD FOR DISPOSAL OF RADIOACTIVE WASTE

[76] Inventor: Joe K. Welch, P. O. Box 753, Temple, Tex. 76503

[21] Appl. No.: 870,001

[22] Filed: Feb. 8, 1993

Related U.S. Application Data

[63] Continuation-in-part of Ser. No. 328,906, Dec. 14, 1989, abandoned.

[51] Int. Cl.[5] ..... G21F 9/00

[52] U.S. Cl. ..... 588/16; 405/128; 588/17

[58] Field of Search ..... 252/633, 628; 405/128, 405/55

[56] References Cited

U.S. PATENT DOCUMENTS

| | | | |
|---|---|---|---|
| 3,108,439 | 10/1963 | Reynolds et al. | 405/128 |
| 3,335,798 | 8/1967 | Querio et al. | 405/128 |
| 4,040,480 | 8/1977 | Richards | 166/57 |
| 4,320,028 | 3/1982 | Leuchtag | 252/628 |
| 4,708,522 | 11/1987 | Bergman et al. | 405/55 |
| 4,776,409 | 10/1988 | Manchak, Jr. | 175/50 |
| 4,861,194 | 8/1989 | Lang | 405/128 |
| 4,877,353 | 10/1989 | Wisotsky, Sr. | 405/128 |
| 5,202,522 | 4/1993 | Williams | 588/280 |

*Primary Examiner*—Donald P. Walsh
*Assistant Examiner*—Ngoclan T. Mai

[57] ABSTRACT

In a method for the safe disposal of radioactive waste, a drilling rig is used to drill a hole or holes near the scource of the radioactive waste. This hole(s) then becomes the deposit chamber(s) for the radioactive waste. After the hole is dug a well casing is cemented in as is done for oil wells. The radioactive waste is put into stainless steel cylinders with a diameter less than that of the well casing, and with a central axial bore hole. These cylinders have screw threads on the top and bottom which allow them to be attached to each other similar to the way pipe sections are attached to one another in oil well drilling. After the cylinders are filled with radioactive waste, they are lowered into the hole using technology common to the oil industry. The cylinders are treated, in effect, as sections of drill pipe. The top of the last cylinder must be a safe distance below the bottom on any existing water table. The bottom cylinder must have a footing which will allow liquid to flow down from the central bore hole and back up between the cylinders and the wall of the well casing. Depending upon the level of radiation in the waste, one can circulate a cooling fluid around the cylinders by pumping the fluid down through the central bore hole and up around the outside of the cylinders. This fluid may be monitored for radioactive levels as appropriate. The final sealing of the hole is accomplished by pumping cement down through the central bore hole and up around the cylinders, displacing the cooling fluid, until the hole is completely filled.

1 Claim, 2 Drawing Sheets

FIG. 1A.
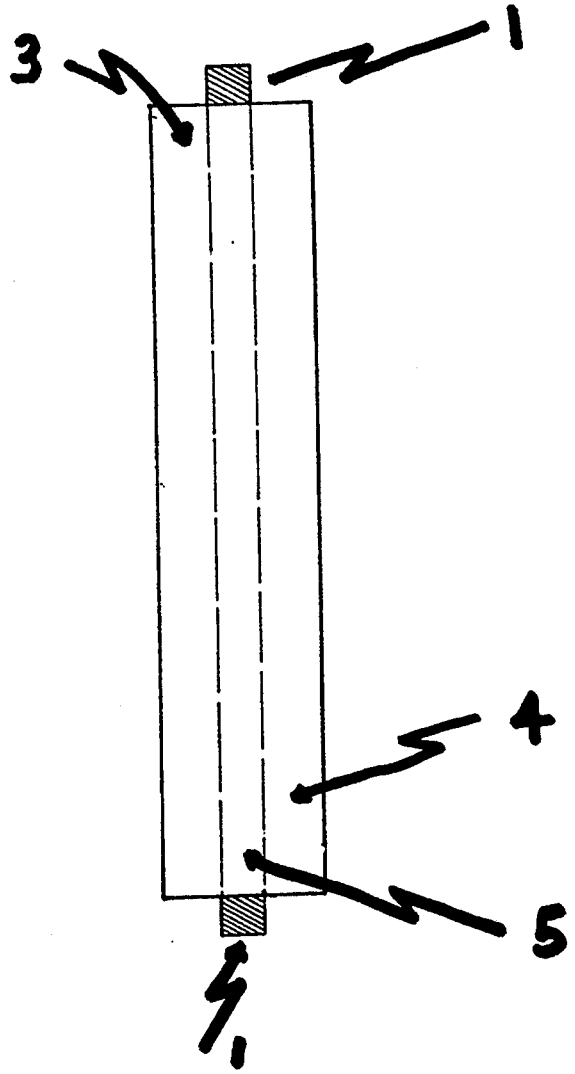
FIG 1B.
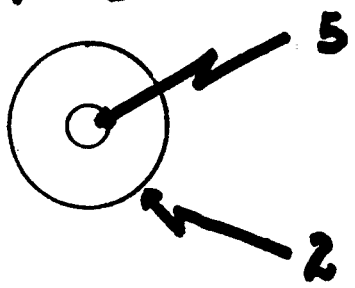
FIG. 1.

METHOD FOR DISPOSAL OF RADIOACTIVE WASTE

CONTINUATION IN PART

This application is a continuation in part of Ser. No. 07/328,906 filed Dec. 14, 1989, now abandoned.

BACKGROUND OF INVENTION

The radioactive waste from the United States' nuclear power plants in 1988 exceeded 22,500 tons, and the amount is growing daily. Radioactive wastes from similar facilities is the rest of the world are of the same order of magnitude. In the United States there is no accepted way to dispose of this waste. The major concern regarding this waste is that it will remain hazardous to living organisms for thousands of years. Any disposal scheme must ensure that in addition to being removed from any contact with living organisms, there will be no leakage into the water table or atmosphere.

None of the various schemes proposed for disposal of radioactive waste have met the approval of the scientific community for satisfying these conditions. Further, those schemes being considered entail the transportation of radioactive waste over regular commercial traffic byways to a designated "radioactive waste dump site." During transport there is a finite possibility of traffic accidents that could lead to leakage of radioactive waste and, consequently, a significant risk to living organisms.

SUMMARY OF THE INVENTION

I have now conceived of a method to safely dispose of radioactive waste for thousands of years. Moreover, this method has the possibility of being utilized at the site where the radioactive waste is generated rather than have to transport it for any distance to a "radioactive dump site."

I call this method the Subterranean Answer For Elimination (S-A-F-E) radioactive waste disposal system. This method consists of using a drilling rig to drill a hole which becomes the deposit chamber for specially designed containers with the radioactive waste contained therein.

After the hole is drilled to a prescribed depth, it should be cased and cemented with materials judged to be safest for the purpose. The depth is determined by the location of any water tables, and the amount of radioactive waste to be disposed. In general, the depth should be about 3,000 to 5,000 feet deeper than the lowest depth of the lowest existing water table. However, the maximum depth of the hole can be as much as about 10,000 feet, so the hole may be much more than 5,000 feet below a water table which is near the surface of the earth.

The novel cylinders of this invention are stainless steel cylinders with a diameter from 2 to 6 inches, preferably about four inches less than that of the inside diameter of the well (hole) casing, and with a central axial bore hole with a diameter of from 3 to 5 inches preferably about four inches. The inside diameter of the well casing is from 15 to 30 inches and normally about 18 to 24 inches, but may be as great as five feet. The cylinders have screw threads on the top and bottom which allow them to be attached to each other in a manner similar to the way pipe sections are attached to one another in oil well drilling. After the cylinders are filled with radioactive waste, they are lowered into the hole using technology similar to the oil industry. The cylinders are treated, in effect, as sections of drill pipe. The difference from standard drilling technology is that the cylinders must be handled with remote control devices rather than by hand.

The top of the last cylinder must be a safe distance below the bottom on any existing water table. This distance must be determined by experts, but I believe it should be about 500 ft to 1,000 feet preferably at least 1,000 feet. The entire hole should be from 2,000 feet to 10,000 feet deep. a footing which will allow liquid to flow down through the central bore hole, and back up between the outside surface cylinders and the inner surface of the well casing.

Depending upon the level of radiation in the waste, one can circulate a cooling fluid around the cylinders by pumping the fluid down through the central bore hole and up around the outside of the cylinders. This fluid may be monitored for radioactive levels as appropriate. When operating the S-A-F-E system in this manner, it is possible to pull the cylinders back to the surface of the earth to remove one or more of the cylinders. This can be done in a manner similar to that currently used in the drilling industry to remove sections of drilling pipe. Again, the difference would be that remote control handling will be required.

The final sealing of the hole is accomplished by pumping cement down through the central bore hole and up around the cylinders, displacing the cooling fluid, until the hole is completely filled.

The invention accordingly comprises of a system of novel cylinders, a means to handle them, and a way dispose of them in an environmentally safe manner. This is exemplified in the detailed disclosure here after set forth, and the scope of the invention will be in the claim.

BRIEF DESCRIPTION OF THE DRAWINGS

For a fuller understanding of the invention, reference is made to the following description taken in connection with the accompanying drawings, in which:

FIGS. 1*a* and 1*b* are schematic views of the novel stainless steel cylinders in accordance with the present invention;

DESCRIPTION OF THE PREFERRED EMBODIMENTS

Figure 2:
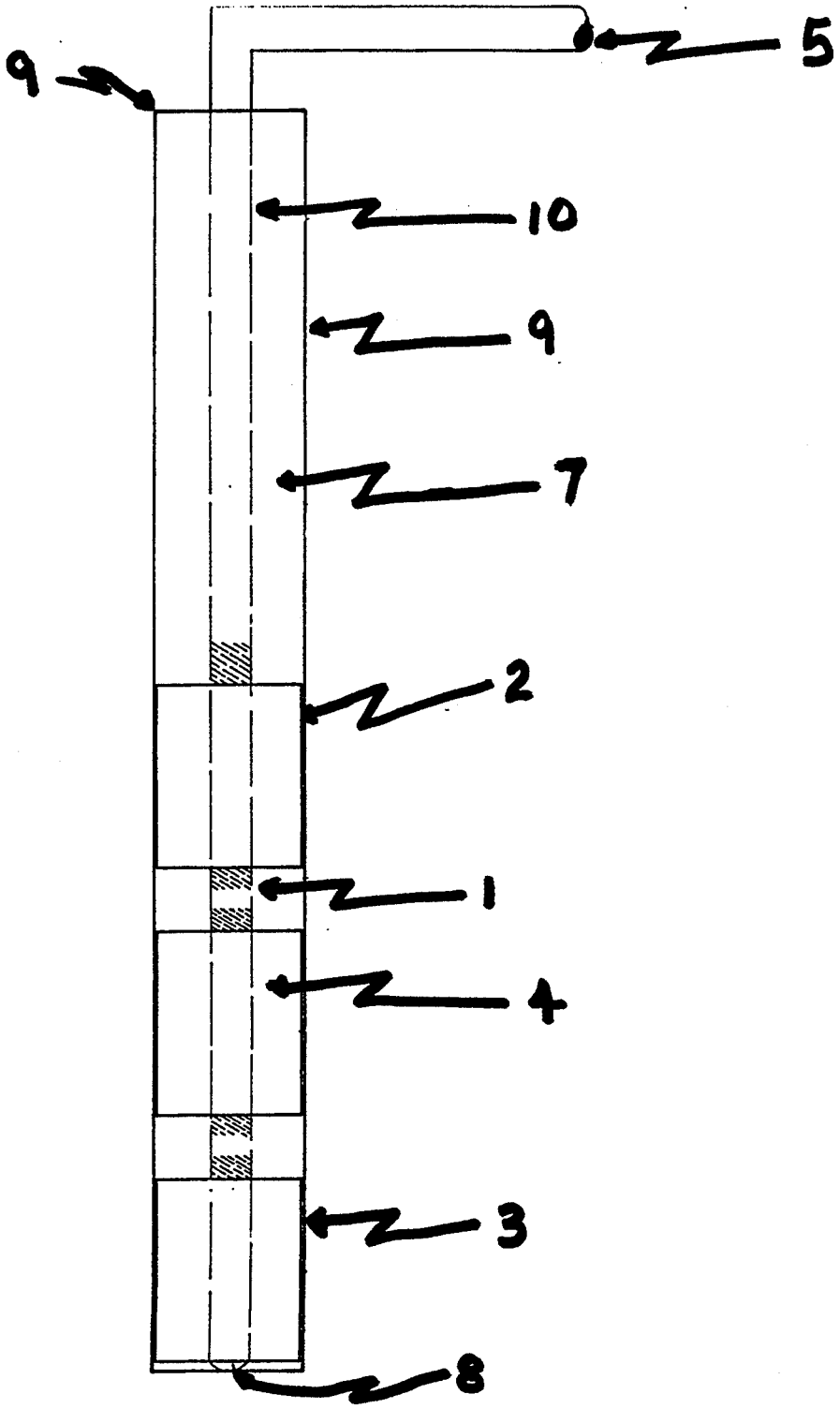
FIG. 2 is a schematic view of the S-A-F-E system illustrating the cylinders inside the well casing and how the cooling and/or sealing fluids are circulated.

The cylinder of this invention is illustrated in FIG. 1 has standard drilling pipe threads on the top, 1, and bottom. These as well as all other parts of the cylinder are made from heavy stainless steel. The cylinders are custom constructed for each disposal hole. The radioactive waste is placed in the cylindrical volume, 4, through an opening in the top of the cylinder. The opening is welded shut to a wall thickness, 3, to be determined by the level of radiation in the radioactive waste and by the dimensions of the disposal well. The diameter of the outside wall of the cylinder, 2, is also determined by the dimensions of the disposal well. In general the diameter of the cylinder is about four inches less than the inside dimension of well casing. Finally, there is a central hole, 5, through which the cooling fluid and/or sealing cement is circulated.

The total system of this invention with the cylinders in place in a disposal well is illustrated in FIG. 2. The cylinders are shown attached to each other using the stainless steel pipe threads, 1. The central hole, 5, through which the cooling fluid or sealing cement is pumped consists of drilling pipe, 10, above the cylinders, and the central holes of the cylinders from the top of the top cylinder to the bottom of the bottom cylinder. The space, 7, above the top cylinder is filled with either cooling fluid or sealing cement. The footing, 8, keeps the bottom cylinder off the bottom of the disposal well so that the cooling fluid or sealing cement may circulate up around the outside of the cylinders. The well casing, 9, is installed by standard drilling procedures.

What is claimed is:

1. A method to safely dispose of radioactive waste for thousands of years which consists of drilling a bore hole from 2,000 to 10,000 feet below the surface of the earth; casing the hole using cement pump down the hole; putting stainless steel cylinders filled with radioactive waste into the hole; and wither cooling or sealing the waste using a circulating system such that:

the cylinders have a diameter from two to six inches less than that of the inside diameter of the hole casing, a central axial bore hole with a diameter from three to five inches, and standard pipe screw threads on the top and bottom which allow the cylinders to be attached to one another;

the inside diameter of the well casing is from 15 to 30 inches;

the top of the last cylinder put in the hole is at least 1,000 feet, below the bottom of any existing water table through which the hole passes;

the bottom of the first cylinder put into the hole has a footing that allows liquid to flow down through the central bore hole, and back up between the outside surface of the cylinders and the inner surface of the well casing.

* * * * *